US007897318B2

(12) United States Patent
Peter et al.

(10) Patent No.: US 7,897,318 B2
(45) Date of Patent: Mar. 1, 2011

(54) IONIC POLYMER FLOCCULANTS FOR THE PREPARATION OF CHEMICALLY PROCESSED TONER

(75) Inventors: Trent Duane Peter, Johnstown, CO (US); Tao Yu, Louisville, CO (US)

(73) Assignee: Lexmark International, Inc., Lexington, KY (US)

( * ) Notice: Subject to any disclaimer, the term of this patent is extended or adjusted under 35 U.S.C. 154(b) by 453 days.

(21) Appl. No.: 11/947,177

(22) Filed: Nov. 29, 2007

(65) Prior Publication Data

US 2009/0142691 A1 Jun. 4, 2009

(51) Int. Cl.
*G03G 9/12* (2006.01)

(52) U.S. Cl. ..... 430/137.14

(58) Field of Classification Search ..... 430/137.14
See application file for complete search history.

(56) References Cited

U.S. PATENT DOCUMENTS

| | | | | |
|---|---|---|---|---|
| 4,370,464 | A | 1/1983 | Tanaka et al. | |
| 4,824,523 | A | 4/1989 | Wagberg et al. | |
| 5,032,484 | A | 7/1991 | DeMejo et al. | |
| 5,344,738 | A | 9/1994 | Kmiecik-Lawrynowicz et al. | |
| 5,433,863 | A | 7/1995 | Braden et al. | |
| 5,451,326 | A | 9/1995 | Carlson et al. | |
| 5,530,069 | A | 6/1996 | Neff et al. | |
| 5,863,698 | A | 1/1999 | Patel et al. | |
| 6,048,438 | A | 4/2000 | Rosencrance et al. | |
| 6,171,505 | B1 | 1/2001 | Maury et al. | |
| 6,238,486 | B1 | 5/2001 | Dunham et al. | |
| 6,268,528 | B1 | 7/2001 | Machida et al. | |
| 6,451,169 | B1 | 9/2002 | Ward et al. | |
| 6,531,254 | B1 | 3/2003 | Bedells et al. | |
| 6,531,256 | B1 | 3/2003 | Bedells et al. | |
| 6,576,594 | B2 | 6/2003 | Nier et al. | |
| 6,930,154 | B2 | 8/2005 | Inagaki et al. | |
| 7,252,783 | B2 | 8/2007 | Weir et al. | |
| 2003/0113651 | A1 * | 6/2003 | Moffat et al. | 430/120 |
| 2007/0065745 | A1 * | 3/2007 | Gerroir et al. | 430/110.2 |
| 2007/0122728 | A1 * | 5/2007 | Vanbesien et al. | 430/108.4 |

* cited by examiner

*Primary Examiner* — Hoa V Le

(57) ABSTRACT

The present disclosure relates to a process for producing a toner particulate composition from aqueous dispersions containing aggregates of a polymer binder and other toner ingredients. An ionic surfactant may be used to form the dispersion along with an ionic polymer flocculent wherein the ionic polymer flocculent undergoes a molecular conformational change, which may be triggered by pH adjustment, leading to flocculation and particle growth.

19 Claims, 3 Drawing Sheets

IONIC POLYMER FLOCCULANTS FOR THE PREPARATION OF CHEMICALLY PROCESSED TONER

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally to chemically processed toner that employs an ionic polymer flocculant which undergoes a molecular conformation change in a toner dispersion thereby leading to flocculation and particle growth.

2. Description of the Related Art

Image forming devices, such as printers or copiers, may utilize toner to form images on various forms of media. Toner may include resin, a wax, colorant and, optionally, additives. Toner may be produced via a number of processes. Some processes are mechanical, wherein the toner components are blended, formed into strands or pellets and then ground to a desired particle size. Other processes are chemical, wherein the toner particles are grown during polymerization and/or emulsion aggregation processes to form desired particle sizes.

SUMMARY OF THE INVENTION

In a first exemplary embodiment, the present disclosure is directed at a process for producing a toner particulate composition. The process may begin by forming an aqueous dispersion comprising aggregates of polymer binder and colorant stabilized by an ionic surfactant including an ionic polymer flocculant containing a plurality of ionic functional groups of opposite charge to the ionic surfactant. The pH of the dispersion may be adjusted to configure the ionic polymer flocculent into a random coil configuration. The pH of the dispersion may then be adjusted to configure the ionic polymer flocculent into a relatively extended chain configuration wherein the ionic groups become available to promote flocculation of the aggregates to a desired size. Heating may then be applied to a temperature above a glass transition temperature of the polymer binder along with collection of particulate.

In a further exemplary embodiment, the present disclosure again relates to a process for producing a toner particulate composition. An aqueous dispersion may be formed comprising aggregates of polymer binder and colorant stabilized by an anionic surfactant including an cationic polymer flocculent containing a plurality of cationic functional groups. The pH of the dispersion may be set to a value of greater than 7.0 along with mixing. The pH of the dispersion may then be adjusted to a value of greater than 4.0 to less than 7.0 to promote flocculation of the aggregates to a desired size. Heating may then be applied to a temperature above a glass transition temperature of the polymer binder along with collection of particulate wherein the particulate has a size range of 3-15 microns.

In yet another exemplary embodiment, the present disclosure again relates to a process for producing toner particulate composition. An aqueous dispersion may be formed comprising aggregates of a polyester binder and colorant stabilized by an anionic surfactant including a cationic polymer flocculent containing a plurality of cationic functional groups. The pH of said dispersion may first be adjusted to a value of greater than 7.0 along with mixing followed by adjustment of the pH of said dispersion to a value of greater than 4.0 to less than 7.0 to promote flocculation of the aggregates to a desired size. Heating may then be applied to a temperature above the glass transition temperature of the polyester binder along with collection of particulate wherein the particulate has a size range of 3-15 microns.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
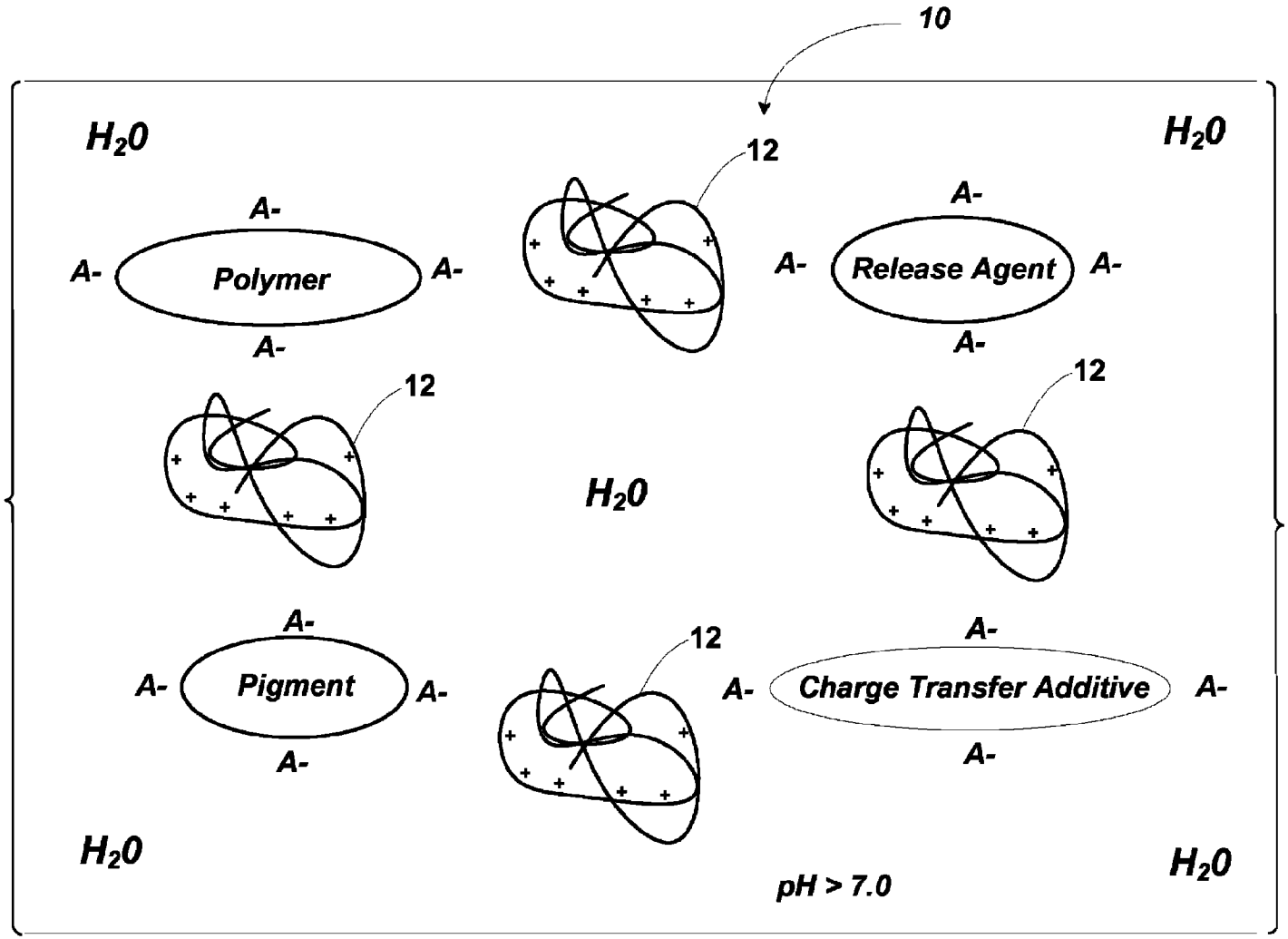
FIG. 1 is an exemplary view of a toner dispersion wherein the polymeric cationic flocculant is illustrated in a random coil configuration at pH>7.0.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

As noted above, toner may be utilized in image forming devices to form images on media, such as paper, transparencies, etc. Devices that use toner may include printers, copiers, fax machines, etc. Generally, toner may include a binder, wax, colorants and, optionally, additives. The binder may be a polymeric type resin, which may provide appropriate fusing characteristics when used in an electrophotographic type printer. Exemplary binders may include thermoplastic type polymers such as styrene or styrene acrylate type polymers, polyester polymers, etc. Colorants may be used herein to describe compositions that may impart color or other visual effects to toner. Colorants may include, pigments, dyes or a combination thereof. The toner composition so formed may be then be positioned within a toner cartridge for an image forming device such as a laser or electrophotographic printer.

As contemplated herein, toner compositions may be produced by chemical processes, wherein the toner particles may be grown in an aqueous solution to obtain a desired particle size. Such growth may occur due to the process of flocculation via the use of an ionic polymer flocculant described more fully below. Flocculation may be understood herein as the process by which destabilized particles conglomerate (due to, e.g., the presence of available counterions) into relatively larger aggregates.

One example of a chemical process for producing toner may begin by dispersing in aqueous media, the individual constituents of the toner composition, i.e., the resin/polymer binder, release agent (wax), colorant (pigment particles), and/or charge transfer additive. Each constituent may be dispersed separately in its own aqueous environment or in one aqueous mixture as may be desired. One may then introduce stabilizing agents containing anionic functional groups (A−), e.g., anionic surfactants and/or anionic polymeric dispersants. One may also use stabilizing agents containing cationic functional groups (C+), e.g., cationic surfactants and/or cationic polymeric dispersants. Whether prepared individually and combined, or in one aqueous medium, the constituents may then be mixed and homogenized to provide a dispersion for the preparation of toner particles. In addition, a surfactant or dispersant may be understood herein as a chemical agent that can lower the interfacial tension of a given organic and/or hydrophobic compound in an aqueous environment or assemble into aggregates (e.g. micelles).

With respect to the anionic surfactants and/or anionic polymeric dispersants, such may include any compound containing a hydrophobic portion and an anionic type hydrophilic group (e.g. a carboxylate group of the structure —$COO^-$). Typically anionic surfactants may therefore include fatty acid soaps, e.g., sodium oleate, sodium plamitate, sodium myristate and/or sodium stearate. One particular suitable anionic surfactant is AKYPO® RLM100 available from KAO Chemicals, which is laureth-11 carboxylic acid thereby providing anionic carboxylate functionality. Other anionic surfactants contemplated herein include alkyl phosphates, alkyl sulfonates and alkyl benzene sulfonates.

In another example of the chemical manufacture of toner according to the present disclosure, polymer latexes may be prepared from the polymerization of vinyl type monomers such as styrene and acrylic in the presence of anionic type surfactants. Pigments may be milled in water along with a surfactant that has the same functionality (and ionic charge) as the surfactant employed in the polymer latex. Waxes (polyolefin and carnauba type at about an 80/20 ratio) may also be prepared with a surfactant that has the same functionality (and ionic charge) as the surfactant employed in the polymer latex. A charge control agent or additive (CCA) may be included. The polymer latex, pigment latex and wax latex may then be mixed and stirred to ensure a homogenous composition followed by the addition of the ionic polymer flocculants noted herein.

As mentioned above, the toners herein include a resin/polymer binder. The terms resin and polymer are used herein interchangeably as there is no technical difference between such descriptions. The resin/polymer binder may therefore include one or more of the following: a styrene and/or substituted styrene polymer, such as homopolymer (e.g., polystyrene) and/or copolymer (e.g., styrene-butadiene copolymer and/or styrene-acrylic copolymer, a styrene-butyl methacrylate copolymer and/or polymers made from stryene-butyl acrylate and other acrylic monomers such as hydroxy acrylates or hydroxy methacrylates); polyesters, polyvinyl acetate, polyalkenes, poly(vinyl chloride), polyurethanes, polyamides, silicones, epoxy resins and phenolic resins. In particular, it should be noted that the methodology herein has been found particularly applicable for the production of condensation type polymer binder formulations where the polymers may be formed by step-growth polycondensation. For example, the methodology herein has been found particularly applicable for the preparation of a polyester based resin binder toner formulation, wherein the polyester is represented by a family of polyester resins under the name NE 701 from KAO Chemicals, with a Tg of 55.6° C. and Tm of 112.6° C.

With respect to the ionic polymer flocculants that may be employed herein, such flocculants may be sourced from a polymer resin contain a plurality of anionic or cationic functional groups. Accordingly, by way of illustration in the case of a cationic polymer flocculant, containing a plurality of functional groups offering a plurality of cationic charges, attention is directed to FIG. 1, wherein one may combine polymer resin, release agent, pigment and a charge transfer additive, in the presence of an anionic surfactant (A−), along with a cationic polymer flocculant 12 and adjust the pH to a value of greater than 7.0 (pH>7.0) to form a dispersion 10 in water. In addition, as noted above, although FIG. 1 identifies these four components in the arrangement of a single dispersion, it may be appreciated that each component (polymer, release agent, pigment and/or charge transfer additive) may be provided as a separate dispersion and then combined. In addition, the particle size of the components in FIG. 1, prior to flocculation, may be on the order of about 10-300 nanometers.

It may therefore be appreciated that as shown in FIG. 1, and under such pH conditions of greater than 7.0, and as generally illustrated, the cationic polymer flocculant containing a plurality of cationic charges may assume a random coil configuration shown generally at 12. Such random coil configuration may be understood to be one of a variety of random coil configurations that may occur for a given polymer, and is a reference to a configuration wherein the cationic groups are not generally available to provide flocculation and particle growth. Such random coil configuration may be promoted due to the relatively basic conditions which may serve to neutralize available cationic groups and allow for a more relatively compact random coil configuration, as illustrated. Under these circumstances the anionic surfactants (A−) may operate to stabilize the dispersion and maintain the components (polymer, release agent, pigment and/or charge transfer agent) as relatively separate aggregates.

Figure 2:
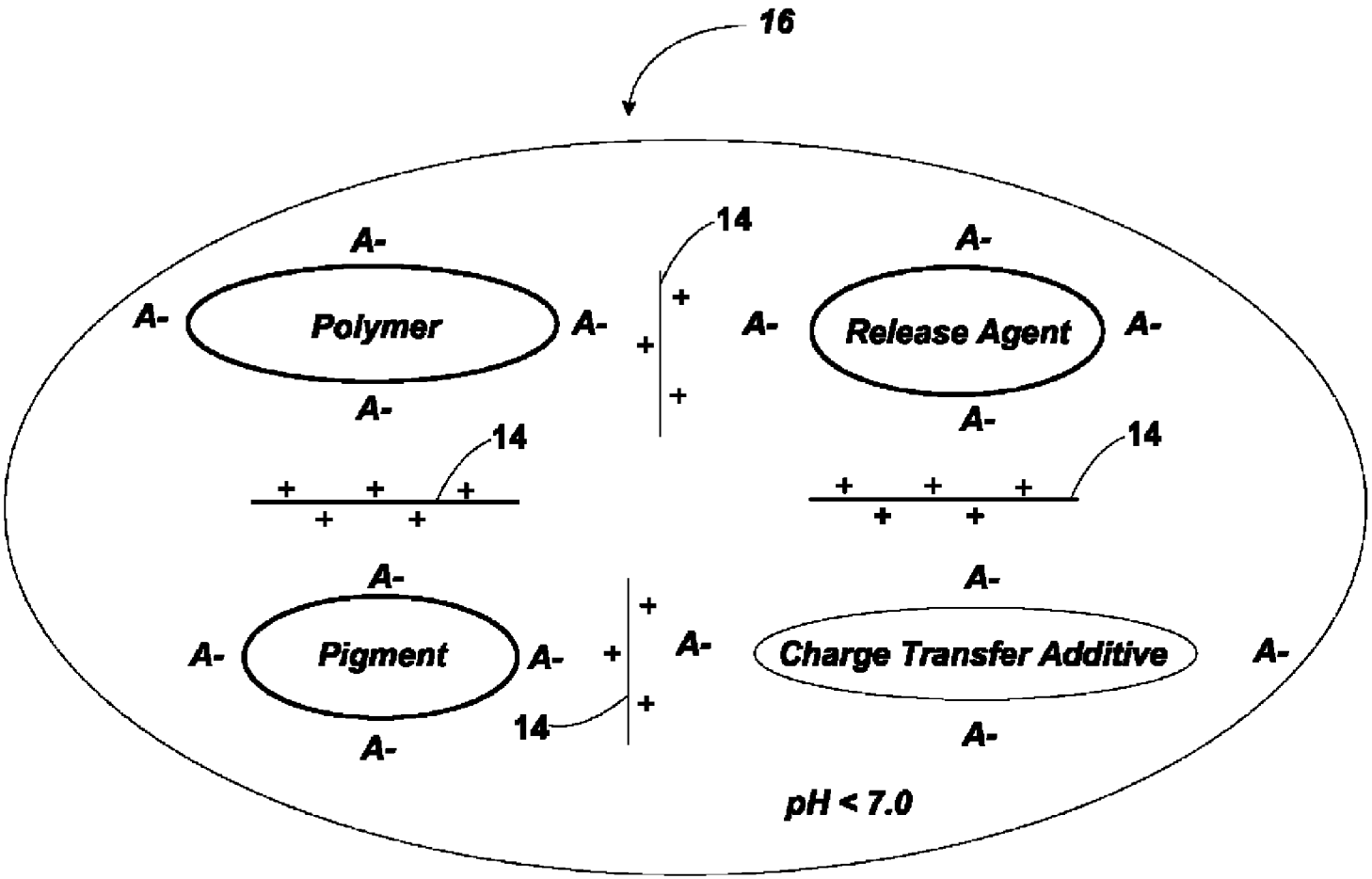
FIG. 2 is an exemplary view of a toner dispersion wherein the cationic polymer flocculant is illustrated in an extended chain conformation (pH<7.0) thereby triggering flocculation and growth of relatively larger particles.

When adjusting the pH of the dispersion in FIG. 1 to a pH of less than 7.0, via the addition of acid, the development of a relatively acidic environment may now reconfigure the cationic polymer flocculant into a relatively more extended chain configuration, illustrated generally at 14 in FIG. 2. Again, the extended chain configuration shown is only for illustration purposes, and it may be understood herein that an extended chain configuration is one in which the cationic functional groups become available to promote flocculation. That is, the available cationic charges of the cationic polymer flocculant may now provide charge neutralization to the anionic surfactants which in turn may trigger flocculation and growth of particles to a desired particle size (e.g. 1-10 microns), which growth may be assisted by heating to a temperature below the glass transition temperature of the polymer. In addition, it is possible under such pH conditions (pH<7.0) that the cationic polymer flocculant may also become absorbed onto the surface of either the polymer, pigment, release agent or charge transfer additive and act as a bridging type flocculant to again provide for particle growth.

Once a desired particle size has been obtained during flocculation the pH may again be adjusted to prevent further particle growth and one may then restabilize the dispersion of formed toner particles. Accordingly, while not illustrated, it should now be appreciated that the disclosure here applies equally as well to the reverse situation. That is, one may form a toner dispersion using cationic type surfactants and employ an anionic polymer flocculent containing a plurality of anionic charges on the polymer chain, which anionic polymer flocculant may be configured to assume a random-coil configuration at a pH of less than 7.0. Upon adjustment of the pH to a value of greater than 7.0, such anionic polymer flocculent may then similarly assume a relatively extended chain configuration and again provide for flocculation (charge neutralization and/or bridging) and particle growth.

In addition, the ionic polymer flocculants herein may be used in combination with zinc or aluminum salts, such as $Al_2(SO_4)_3$. In addition, one may also employ ferric and ferrous type salts, such as $FeCl_3$ or $Fe_2(SO_4)_3$. Such inorganic compounds may be introduced into the toner dispersion to control the ionic strength of the aqueous phase to promote flocculation.

It should therefore now be appreciated that while pH may be used herein as a switch to trigger flocculation and for re-stabilization, the pH adjustment herein is selected to provide a reversible molecular conformational change in the ionic polymer flocculent (random coil to extended chain and vice versa) so that charge neutralization and/or bridging may be utilized to flocculate and grow to a desired toner particle size. In the case of a cationic polymer flocculant, the pH for flocculation may therefore be in the range of equal to or greater than 4.0 and less than 7.0, including all values and increments therein. For example, flocculation may be triggered by a pH of about 4.5-5.5 as applied to a dispersion containing, e.g., a polyester or a styrene-acrylic polymer binder in the presence of a cationic polymer flocculant. It should therefore be noted that by utilizing the conformational change of the flocculant one may avoid the relatively larger pH changes that may otherwise be necessary to provide particle growth. For example, in a toner dispersion employing only anionic surfactants without the presence of the cationic flocculants disclosed herein, a pH environment of about 1-2 may be necessary to trigger flocculation and particle growth. Therefore it should be appreciated that the pH change herein is that which is sufficient to cause flocculent conformational change to induce flocculation and it is not necessary to induce a change in the actual charge of the anionic functional groups of those anionic surfactants that may be present to stabilize the dispersion containing the various toner ingredients.

Considering the above, it may now be appreciated that in the case of a dispersion stabilized by cationic surfactants and/or cationic polymer dispersants, one may form a toner dispersion containing such cationic surfactants and/or cationic polymer dispersants in the presence of an anionic polymer flocculant. The anionic polymer flocculant may first be maintained in a relatively random coil configuration at a pH of <7.0, thereby allowing for the development of a stable dispersion, containing resin/polymer binder and other selected toner ingredients (again, pigment, release agent and/or a charge control additive). Flocculation may then be triggered by adjustment of the pH to a value greater than 7.0 and less than or equal to 10.0, including all values and increments therein. At such pH levels it is contemplated that the anionic polymer flocculant will assume a relatively extended chain configuration and make available the anionic functional groups which may then similarly provide charge neutralization and/or bridging along with flocculation and particle growth.

Figure 3:
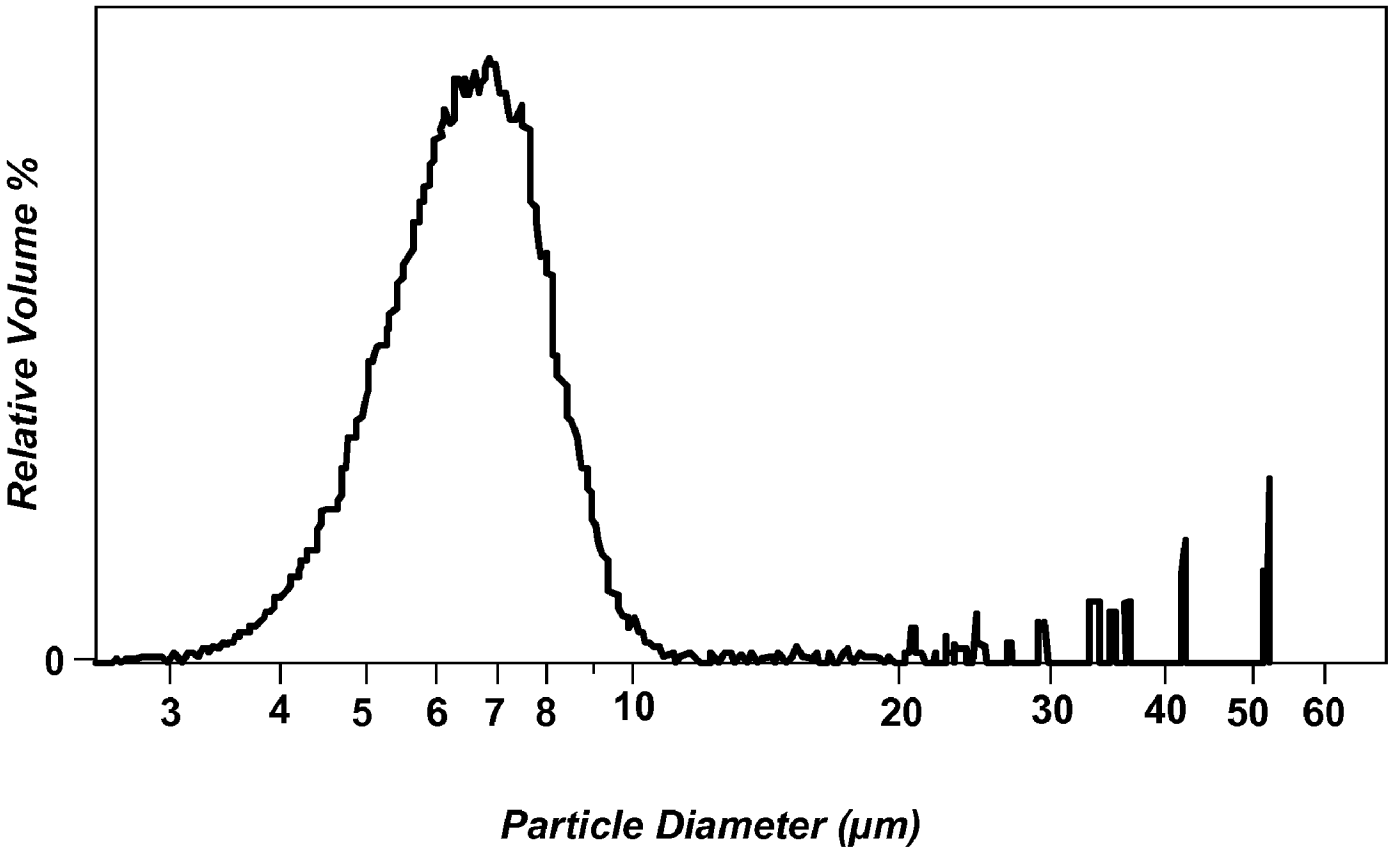
FIG. 3 is a plot of the relative volume particle size distribution of toner particles prepared herein via the use of a cationic polymer flocculant.

After flocculation to a desired particle size (e.g. 3-15 microns as the longest linear dimension or particulate diameter), and in the case of the use of a cationic polymer flocculant, the pH may again be adjusted back to a value of greater than 7.0 (e.g. greater than 7.0 to 9.0) by the addition of an inorganic base (e.g. NaOH) to control against further particle growth. At such point mixing may continue with heating to above the glass transition temperature (Tg) of the polymer resin while monitoring and holding pH at, e.g., about 8.5. This then provides coalescence within the aggregates (disappearance of one or more of the boundaries between, e.g., the polymer, release agent, pigment and/or charge transfer agent) to provide the final toner particles. FIG. 3 illustrates the relative volume size particle distribution of an exemplary polyester based toner formed via the use of a cationic polymer flocculant noted herein. As can be seen, the volume size particle distribution of the toner particles may fall in the range of between 3-11 microns, with the majority of particles having a particle size of about 6.0 to 8.0 microns. It is worth noting that such volume size particle distribution was observed to be nearly the same as the volume size particle distribution that relied upon relatively wider pH switching, as disclosed, e.g., in U.S. Pat. Nos. 6,531,254 and 6,531,256.

Specific examples of cationic polymer flocculants that may be employed herein include those available from CIBA Specialty Chemicals under the trademarks AGEFLOC, AGEFLOC A50, B50, WT35, WT905 etc. and ZETAG, ZETAG 7689, ZETAG 7867, etc. In general, the cationic polymer flocculants may include polyalkylamines and/or polyacrylamide type polymers configured to supply a plurality of cationic charges on the identified polymer chain. For example, in the case of a polyalkylamine, also including the group of polymers commonly referred to as polyvinylamine and/or polyallylamine, such polymers may have the following general structure:

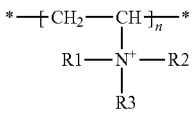

wherein R1, R2 and R3 may include alkyl groups, aromatic groups, or substituted aromatic groups and the value of n may be 10-10,000. In addition, such polyalkylamines may specifically have a number average molecular weight (Mn) of between 1000-1,000,000. Furthermore, polyalkylamine copolymers may be employed with the following general structure:

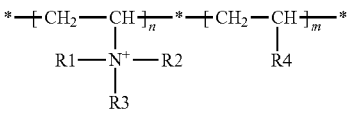

where the values of n and m may each individually be between 10-10,000. In addition, in the above equation, R1, R2, R3 and R4 may include alkyl groups, aromatic groups, or substituted aromatic groups. As may be appreciated, the use of the above reference copolymer configuration and the ability to adjust the values of n and m provide the opportunity to regulate the number of cationic charges along the length of the polymer chain to trigger flocculation and particle growth, as described above.

Other examples of cationic polymer flocculants may include polyacrylamide type resins, which may have the following general structure:

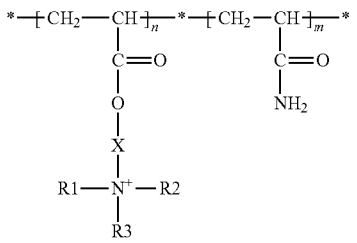

As above, the values of n and m may each be 10-10,000 and the value of Mn may be 1000-1,000,000. In addition, R1, R2 and R3 may again be selected from alkyl groups, aromatic groups and/or a substituted aromatic groups. Still further, another cationic polymer flocculent, which provides a cationic charge along the main chain, may include polyethyleneimine which may have the following general structure

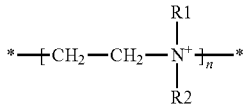

wherein R1 and R2 may again be selected from alkyl groups, aromatic groups and/or a substituted aromatic group and the value of n may again be 10-10,000, the value of Mn may be 1000-1,000,000.

A still further example of a cationic polymer flocculant may include those polymers that are obtained from the reaction of a substituted amine and epichlorohydrin which then provides the following general structure:

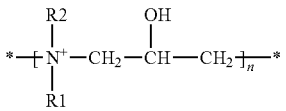

In the above, R1 and R2 may again be selected from alkyl groups, aromatic groups and/or a substituted aromatic groups and the value of n is between 10-10,000.

In addition, specific examples of anionic type polymer flocculants may include, e.g., carboxylic functionalized polymers, such as polyacrylic acid and/or poly(meth)acrylic acid. As may be appreciated, in ionized form, such polymers may provide a plurality of negatively charged carboxylate functional groups. As noted above, such anionic type polymer flocculants may similarly be configured to undergo a conformational change from a relatively compact random coil configuration to an relatively extended chain configuration, and trigger flocculation of a toner dispersion relying upon cationic surfactants.

EXAMPLE 1

A working example of a method of chemically forming toner particles herein begins with first providing an aqueous mixture of polymer resin, pigment, release agent and charge transfer additive. The batch size was 2000 grams. The binder was a mixed acrylic based polymer resin latex available from DSM Resins of Wilmington, Mass., under the general name of NEOCRYL 3000, NEOCRYL 3025 and NEOCRYL 3050. The pH of the aqueous solution is adjusted to a pH in the range of 7 to 10 by the addition of a base, such as 4% NaOH solution. The anionic surfactant is then added to the aqueous solution to provide the dispersion. The ionic surfactant is an alkylene glycol ether carboxylate known as Akypo RLM 100, available from KAO Chemicals of Highpoint, N.C.

Flocculation is then achieved by addition of the cationic polymer flocculant (AGEFLOC B50) which may then be followed by the addition of acid and/or a metallic salt, wherein the pH is lowered to a value of less than 7.0 and greater than 4.0. The acid was a 1.0% $H_2SO_4$ solution and the multi-valent salt included a 2.0% ferrous chloride solution. In such relatively acidic medium the polymer flocculant assumes the relatively extended chain configuration and triggered flocculation wherein the mixture was heated to within about 20° C. of the Tg of the polymer/binder resin. The heating and pH control provide particle growth and the temperature and pH was maintained at the desired levels until the particles reached their desired size (3-11 microns).

Once the desired size had been obtained, the pH of the solution was reversed to a pH of greater than 7. The clusters were then heated to coalesce and form particles of toner. During heating, the temperature of the solution was increased above Tg and to within 20° C. of the melting temperature of the binder resin. After coalescence, the solution was cooled and the toner particles were removed from the mixture. The particles may then be washed. The wash water may be a deionized water. Once washed, the toner particles were dried and may be classified by size or further processed wherein extra particulate agents (EPA) may be added to the particle surface.

EXAMPLE 2

A second working example of a method of chemically forming toner particles herein begins with first providing an aqueous mixture of polymer resin, pigment, release agent and charge transfer additive. The batch size was 2000 grams. In this example, the binder was a polyester emulsion made from TPESL-11, a polyester resin available from KAO Chemicals of High Point, N.C. The pH of the aqueous solution is adjusted to a pH in the range of 7 to 10 by the addition of a base, such as 4% NaOH solution. The anionic surfactant is then added to the aqueous solution to provide the dispersion. The ionic surfactant is an alkylene glycol ether carboxylate known as Akypo RLM 100, available also from KAO Chemicals.

Flocculation is then achieved by addition of the cationic polymer flocculant (AGEFLOC B50) which may then be followed by the addition of acid and/or a metallic salt, wherein the pH is lowered to a value of less than 7.0 and greater than 4.0. The acid was a 1.0% $H_2SO_4$ solution and the multi-valent salt included a 2.0% ferrous chloride solution. In such relatively acidic medium the polymer flocculant assumes the relatively extended chain configuration and triggered flocculation wherein the mixture was heated to within about 20° C. of the Tg of the polymer/binder resin. The heating and pH control provide particle growth and the temperature and pH was maintained at the desired levels until the particles reached their desired size (3-11 microns).

Once the desired size had been obtained, the pH of the solution was reversed to a pH of greater than 7. The clusters were then heated to coalesce and form particles of toner. During heating, the temperature of the solution was increased above Tg and to within 20° C. of the melting temperature of the binder resin. After coalescence, the solution was cooled and the toner particles were removed from the mixture. The particles may then be washed. The wash water may be a deionized water. Once washed, the toner particles were dried and may be classified by size or further processed wherein extra particulate agents (EPA) may be added to the particle surface.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A process for producing a toner particulate composition comprising:

(a) forming an aqueous dispersion comprising aggregates of polymer binder and colorant stabilized by an anionic surfactant and a cationic polymer flocculant containing a plurality of cationic functional groups;

(b) adjusting the pH of said dispersion to a value of greater than 7.0 to configure said cationic polymer flocculant into a random coil configuration and mixing;

(c) adjusting the pH of said dispersion to a value of greater than or equal to 4.0 and less than 7.0 to configure said cationic polymer flocculant into a relatively extended chain configuration wherein said plurality of cationic functional groups become available to promote flocculation and particle growth of said aggregates to a desired size; and (d) heating to a temperature above a glass transition temperature of said polymer binder and collecting particulate.

2. The process of claim 1 wherein said collected particulate has a size range of 3-15 microns.

3. The process of claim 1 wherein said cationic polymer flocculant containing a plurality of cationic functional groups comprises:

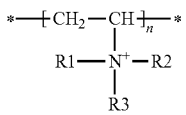

wherein R1, R2 and R3 comprise alkyl groups, aromatic groups, or substituted aromatic groups and the value of n is 10-10,000.

4. The process of claim 1 wherein said cationic polymer flocculant containing a plurality of cationic functional groups comprises:

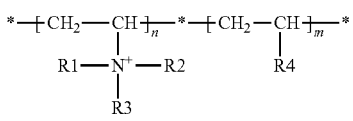

wherein R1, R2, R3 and R4 comprise alkyl groups, aromatic groups, or substituted aromatic groups and the values of n and m may each individually be between 10-10,000.

5. The process of claim 1 wherein said cationic polymer flocculant containing a plurality of cationic functional groups comprises:

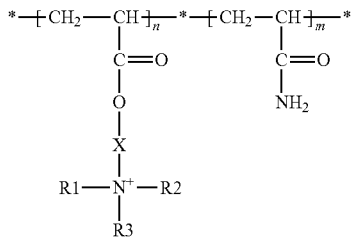

wherein R1, R2 and R3 comprise alkyl groups, aromatic groups, or substituted aromatic groups and the values of n and m may each individually be between 10-10,000.

6. The process of claim 1 wherein said cationic polymer flocculant containing a plurality of cationic functional groups comprises:

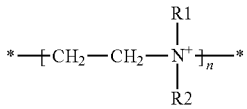

wherein R1 and R2 are selected from alkyl groups, aromatic groups, substituted aromatic groups, or combination thereof and the value of n is between 10-10,000.

7. The process of claim 1 wherein said cationic polymer flocculant containing a plurality of cationic functional groups comprises:

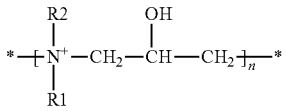

wherein R1 and R2 are selected from alkyl groups, aromatic groups, substituted aromatic groups, or combination thereof and the value of n is between 10-10,000.

8. The process of claim 1 wherein flocculation of said aggregates by said extended chain configuration of said cationic polymer flocculant occurs by charge neutralization of said cationic functional groups on said anionic surfactant.

9. The process of claim 1 including adding an inorganic salt to promote flocculation of said aggregates to a desired size.

10. The process of claim 1 wherein said particulate is positioned within a toner cartridge for an image forming apparatus.

11. A process for producing toner particulate composition comprising:

(a) forming an aqueous dispersion comprising aggregates of polymer binder and colorant stabilized by an anionic surfactant and a cationic polymer flocculant containing a plurality of cationic functional groups, wherein said cationic polymer flocculant includes polyalkylamine type polymers, polyacrylamide type polymers, or combination thereof;

(b) adjusting the pH of said dispersion to a value of greater than 7.0 to configure said cationic polymer flocculant into a random coil configuration and mixing;

(c) adjusting the pH of said dispersion to a value of greater than 4.0 to less than 7.0 to configure said cationic polymer flocculant into a relatively extended chain configuration wherein said plurality of cationic functional groups become available to promote flocculation and particle growth of said aggregates to a desired size; and (d) heating to a temperature above a glass transition temperature of said polymer binder and collecting particulate wherein said particulate has a size range of 3-15 microns.

12. The process of claim 11 wherein said cationic polyalkylamine flocculant comprises:

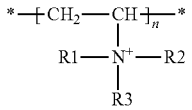

wherein R1, R2 and R3 comprise alkyl groups, aromatic groups, or substituted aromatic groups and the value of n is 10-10,000.

13. The process of claim 11 wherein said cationic polyalkylamine flocculant comprises:

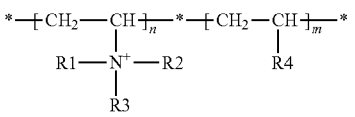

wherein R1, R2, R3 and R4 comprise alkyl groups, aromatic groups, or substituted aromatic groups and the values of n and m may each individually be between 10-10,000.

14. The process of claim 11 wherein said cationic polyacrylamide flocculant comprises:

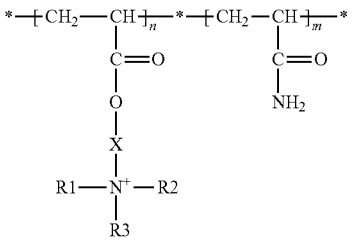

wherein R1, R2 and R3 comprise alkyl groups, aromatic groups, or substituted aromatic groups and the values of n and m may each individually be between 10-10,000.

15. The process of claim 11 wherein said cationic polyalkylamine flocculant containing a plurality of cationic functional groups comprises:

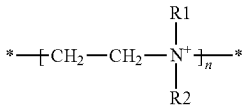

wherein R1 and R2 are selected from alkyl groups, aromatic groups, substituted aromatic groups, or combination thereof and the value of n is between 10-10,000.

16. The process of claim 11 wherein said cationic polyalkylamine flocculant containing a plurality of cationic functional groups comprises:

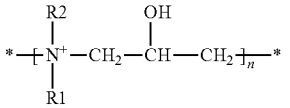

wherein R1 and R2 are selected from alkyl groups, aromatic groups, substituted aromatic groups, or combination thereof and the value of n is between 10-10,000.

17. The process of claim 11 wherein said particulate is positioned within a toner cartridge for an image forming apparatus.

18. A process for producing toner particulate composition comprising:

(a) forming an aqueous dispersion comprising aggregates of polyester binder and colorant stabilized by an anionic surfactant including a cationic polyalkylamine flocculant containing a plurality of cationic functional groups;

(b) adjusting the pH of said dispersion to a value of greater than 7.0 to configure said cationic polymer flocculant into a random coil configuration and mixing;

(c) adjusting the pH of said dispersion to a value of about 4.5 to about 5.5 to configure said cationic polymer flocculant into a relatively extended chain configuration wherein said plurality of cationic functional groups become available to promote flocculation and particle growth of said aggregates to a desired size; and (d) heating to a temperature above a glass transition temperature of said polyester binder and collecting particulate wherein said particulate has a size range of 3-15 microns, wherein said cationic polyalkylamine flocculant comprises:

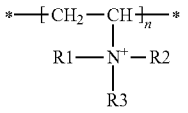

wherein R1, R2 and R3 comprise alkyl groups, aromatic groups, or substituted aromatic groups and the value of n is 10-10,000.

19. The process of claim 18 further comprising re-adjusting the pH of said dispersion from a value of about 4.5 to about 5.5 to a value of greater than 7.0 prior to heating to control further flocculation of said aggregates.

* * * * *